US005253583A

United States Patent [19]

Yamamoto et al.

[11] Patent Number: 5,253,583

[45] Date of Patent: Oct. 19, 1993

[54] DEVICE FOR POSITIONING PRINTING MATERIAL FOR USE IN A PRINTING APPARATUS

[75] Inventors: Hiroshi Yamamoto; Kenro Shimamoto, both of Higashihiroshima, Japan

[73] Assignees: Fuji Kikai Kogyo Kabushiki Kaisha, Hiroshima; Dainippon Ink and Chemicals, Inc., Tokyo, both of Japan

[21] Appl. No.: 843,773

[22] Filed: Feb. 26, 1992

[30] Foreign Application Priority Data

Mar. 4, 1991 [JP] Japan ..... 3-010932[U]

[51] Int. Cl.[5] ..... B41F 1/30

[52] U.S. Cl. ..... 101/409; 101/410; 101/415.1

[58] Field of Search ..... 101/409, 410, 408, 407.1, 101/415.1; 271/226, 234, 243, 253, 255

[56] References Cited

U.S. PATENT DOCUMENTS

| | | | |
|---|---|---|---|
| 3,985,074 | 10/1976 | Bonsch | 101/410 |
| 4,860,651 | 8/1989 | Ishii et al. | 101/409 |
| 4,947,748 | 8/1990 | Hiltwein et al. | 101/409 |
| 5,048,816 | 9/1991 | Chun et al. | 271/255 |

FOREIGN PATENT DOCUMENTS

| | | |
|---|---|---|
| 0412720 | 2/1991 | European Pat. Off. . |
| 2314302 | 9/1974 | Fed. Rep. of Germany . |
| 2170785 | 8/1986 | United Kingdom . |

*Primary Examiner*—Edgar S. Burr
*Assistant Examiner*—Anthony H. Nguyen
*Attorney, Agent, or Firm*—Jordan and Hamburg

[57] ABSTRACT

A device for positioning printing material for use in a printing apparatus in which printing is applied to the printing material by passing the same through between an impression cylinder and a blanket cylinder, the device comprising positioning member disposed in an recessed portion formed on an outer surface of the impression cylinder, the positioning member including, a stopper with which a leading end of the printing material comes to contact, drive means for moving the stopper forward and backward in a direction of transport of the printing material, control unit for controllably driving the drive means while the impression cylinder is being rotated, and operation means for operating the control means. Accordingly, displacement of superimposed printed images in a direction of transport of the printing material resulting from the fact that the positioning member improperly positions printing material can be corrected rapidly and accurately.

4 Claims, 7 Drawing Sheets

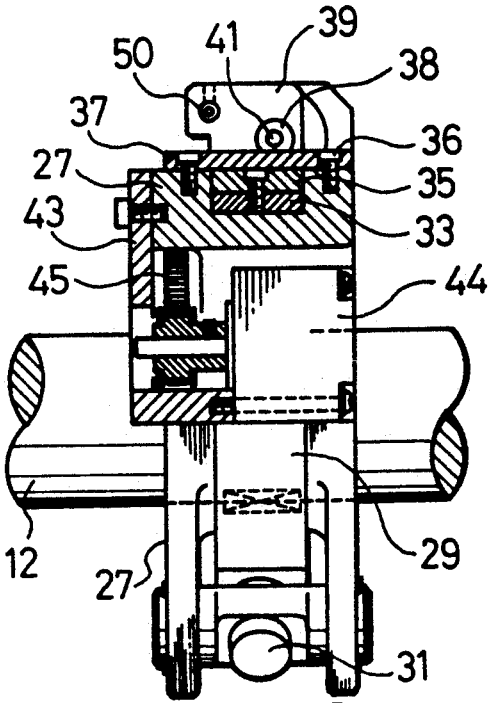
FIG. 5
FIG. 6
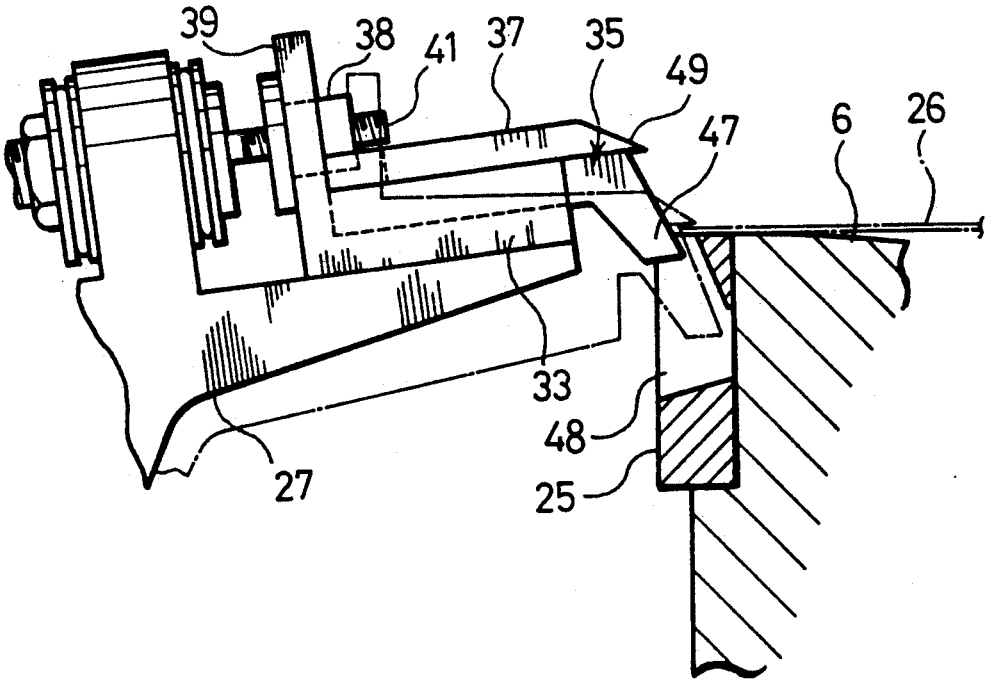

DEVICE FOR POSITIONING PRINTING MATERIAL FOR USE IN A PRINTING APPARATUS

BACKGROUND OF THE INVENTION AND RELATED ART STATEMENT

This invention relates to a device for positioning material to be printed for use in a printing apparatus in which printing is applied to material made of metal sheet material such as aluminum plate and tin plate.

In the conventional printing apparatus shown in FIG. 10, a stopper (gripper face) 61 is provided in a specified position on a circumferential surface of an impression cylinder 60. A leading end of material 26 to be printed (hereinafter referred to as printing material 26) in contact with the stopper 61 is pressed and held against a positioning plate 62 by an unillustrated holding claw. In this way, the printing material 26 is positioned with respect to a specified image area defined on a surface of an unillustrated blanket cylinder, so that the image on the blanket cylinder is transferred to the printing material 26 at a proper position. The stopper 61 is formed at a leading end of a lower member 67 supported slidably on a leading end portion of a pivotal arm 64 pivotally supported to a support shaft 63. The lower member 67 is disposed below an upper member 66 secured to the pivotal arm 64 with a mounting bolt 65. To the upper member 66 is rotatably mounted an eccentric pin 68. When the eccentric pin 68 is rotated with the mounting bolt 65 unfastened, the lower member 67 moves forward and backward in a direction of transport of the printing material 26, whereby the position of the stopper 61 is minutely adjusted.

With the positioning device thus constructed, when the position of the stopper 61 is to be minutely adjusted, it is necessary that the printing apparatus is stopped, and the eccentric pin 68 is manually rotated to move the lower member 67 forward and backward. The printing apparatus is started again after the minute adjustment is made, and a printed state of the printing material is checked during a printing operation. Accordingly, it has been the problem that the printing operation is repeatedly started and stopped to perform adjustment of the stopper 61 until displacement of images superimposed on the printing material is completely corrected.

It is an object of the present invention to overcome the foregoing problem and to provide a device for positioning printing material for use in a printing apparatus which can adjust a position of a stopper rapidly and accurately.

SUMMARY OF THE INVENTION

Accordingly, the present invention is directed to a device for positioning printing material for use in a printing apparatus in which printing is applied to the printing material by passing the same through between an impression cylinder and a blanket cylinder, the device comprising positioning means disposed in an recessed portion formed on an outer surface of the impression cylinder, the positioning means including a stopper with which a leading end of the printing material comes to contact, drive means for moving the stopper forward and backward in a direction of transport of the printing material, control means for controllably driving the drive means while the impression cylinder is being rotated and operation means for operating the control means, and operation means for operating the control means.

Also, the positioning means may further include a slide member mounted to the stopper slidably in a circumferential direction of the impression cylinder and the drive means may slidingly drive the slide member to move the stopper forward and backward.

With the positioning device thus constructed, an adjustment amount of the stopper is designated by means of the operation means to the control means, which in turn drives the drive means. The stopper of the positioning means disposed in the recessed portion of the impression cylinder is moved by the drive means forward or backward in the transport direction of the printing material, thereby properly positioning the printing material. This positioning of the printing material is performed while the impression cylinder is being rotated. Accordingly, the position of the stopper can be adjusted without stopping the printing apparatus, and the displacement of superimposed printed images on the printing material can be corrected rapidly and accurately.

These and other objects, features and advantages of the present invention will become more apparent upon a reading of the following detailed description and accompanying drawings.

BRIEF DESCRIPTION OF THE DRAWINGS

FIG. 5 is a sectional view taken along the line 5—5 in FIG. 4, the view showing the construction of the positioning member;

FIG. 6 is a diagram enlargedly showing the positioning member in its inoperative position and stand-by position;

DETAILED DESCRIPTION OF PREFERRED EMBODIMENTS OF THE INVENTION

In the description to be made hereinbelow, a leading end of any part of a positioning device is opposing to a leading end of printing material.

Figure 1:
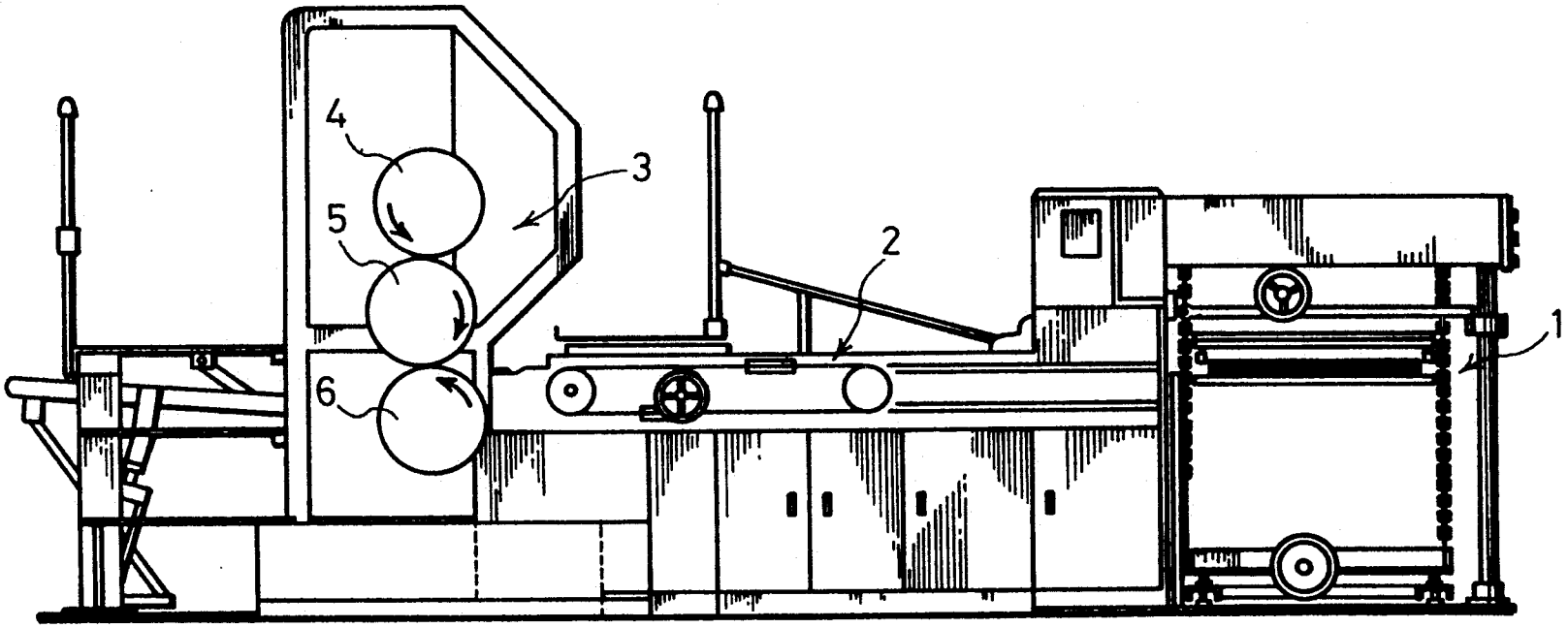
FIG. 1 is a diagram showing an entire construction of a printing apparatus provided with a positioning device embodying the invention.
Figure 2:
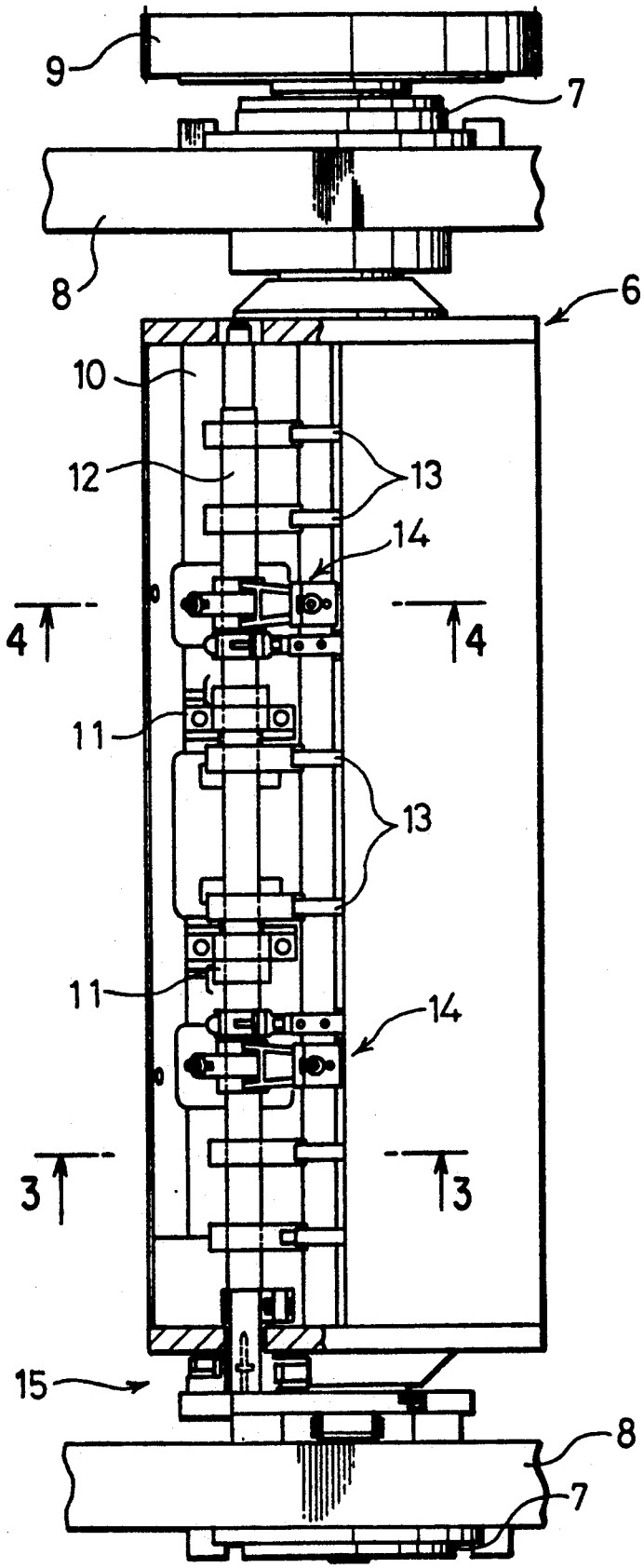
FIG. 2 is a plan view showing a construction of an impression cylinder.

FIG. 1 shows a printing apparatus having a container 1 for containing therein printing material of the sheet type, transport assembly 2 for transporting printing material dispensed one by one from the container 1, and a printing assembly for applying printing to the printing material transported thereto. The printing assembly 3 is provided with a plate cylinder 4, blanket cylinder 5 and impression cylinder 6. The impression cylinder 6 is rotatably mounted to an apparatus frame 8 by way of bearings 7 as shown in FIG. 2. Further, to one end of the impression cylinder 6 is fixed a drive gear 9 which is coupled to unillustrated drive means. Moreover, a recessed portion 10 having a specified width is formed in the impression cylinder 6 along its entire length, i.e., in a vertical direction in the drawing of FIG. 2. A positioning device in accordance with the present invention is disposed in the recessed portion 10.

The positioning device is provided with a support shaft 12, a plurality of holding member 13 attached to the support shaft 12 at specified intervals, a pair of positioning member 14 spaced away from each other along the support shaft 12, cam mechanism 15. The support shaft 12 is rotatably mounted to side faces of the impression cylinder 6, and bearings 11 spaced away from each other are mounted to the support shaft 12. The cam mechanism 15 drivingly rotates the support shaft 12 to cause the holding members 13 and positioning member 14 to pivot at a specified timing.

Figure 3:
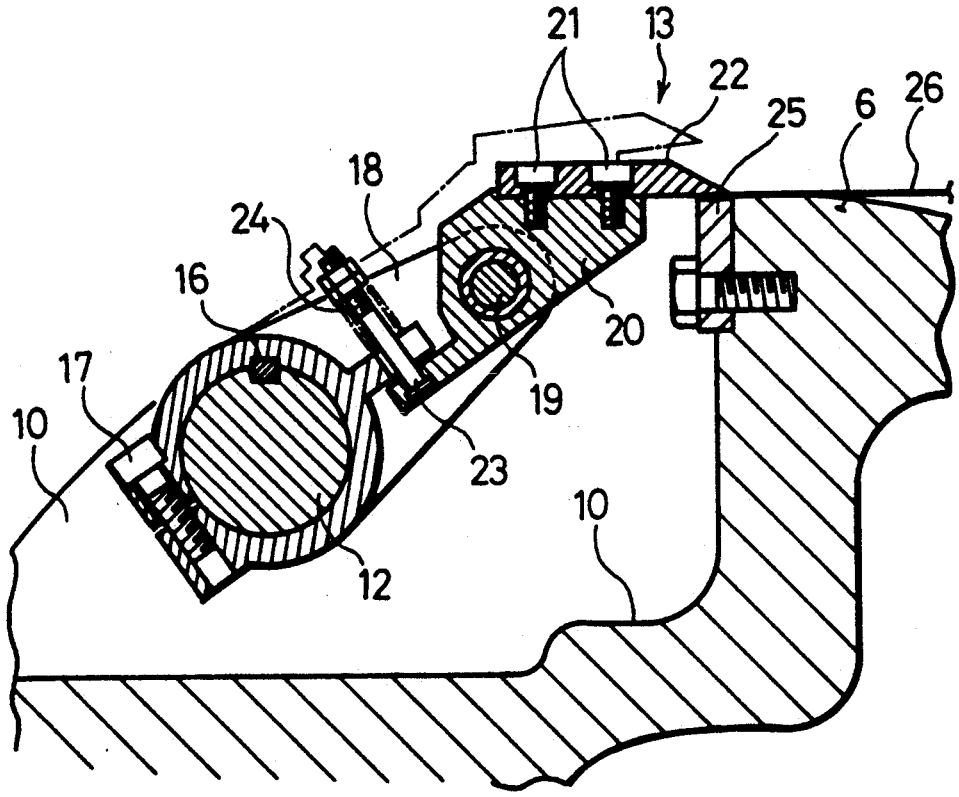
FIG. 3 is a sectional view taken along the line 3—3 in FIG. 2, the view showing a construction of a holding member.

As shown in FIG. 3, each of the holding members 13 includes a drive arm 18, support member 20, holding claw 22, coupling bolt 23, and biasing member 24. The drive arm 18 is fixed to the support shaft 12 at a base end thereof with a key 16 and mounting bolt 17. The support member 20 is pivotably connected to a forward end of the drive arm 18 by way of a shaft 19. The holding claw 22 is secured to an upper face of the support member 20 with a bolt 21. The coupling bolt 23 connects a base end of the support member 20 to the drive arm 18. The biasing member 24, including a compression spring, is externally fitted to the coupling bolt 23 and biases the support member 20 in such a direction as to move the holding claw 22 downward. The holding member 13 is constructed to pivot with rotation of the support shaft 12 drivingly rotated by the cam mechanism 15 between an inoperative position indicated by a phantom line in FIG. 3 and a holding position indicated by a solid line in FIG. 3. With the holding member 13 in the inoperative position, a tip of the holding claw 22 is away from a positioning plate 25 provided on the impression cylinder 6. With the holding member 13 in the holding position, the tip of the holding claw 22 is in pressing contact with a leading end of printing material 26 against the positioning plate 25.

Figure 4:
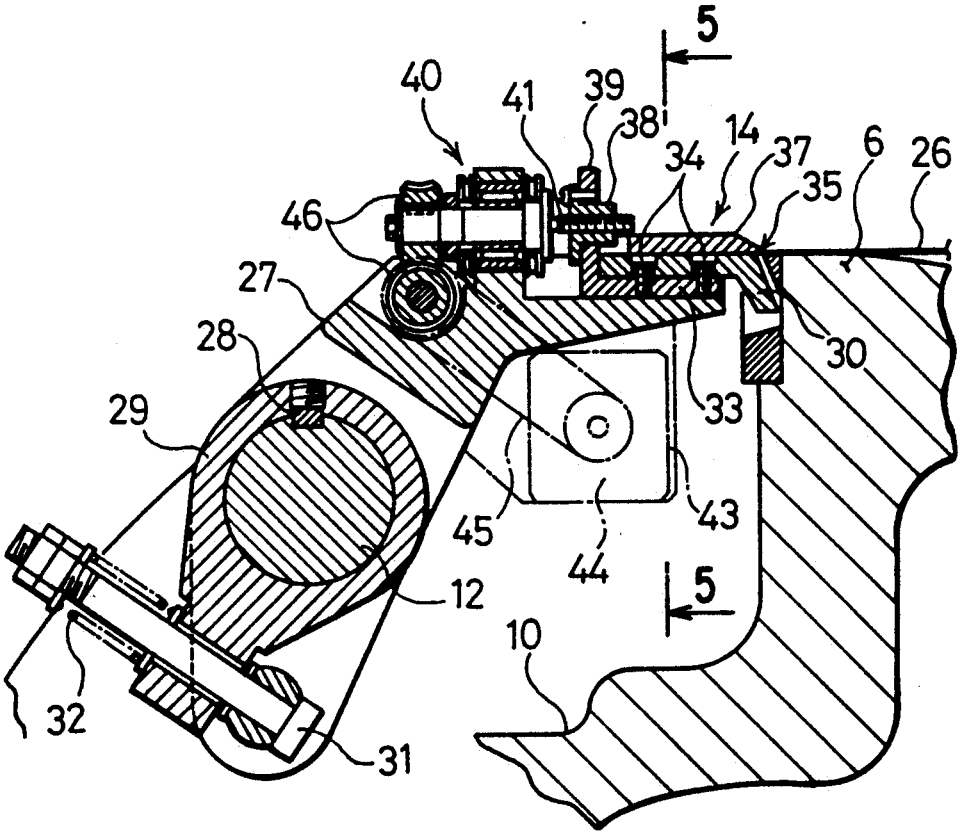
FIG. 4 is a sectional view taken along the line 4—4 in FIG. 2, the view showing a construction of a positioning member.

As shown in FIGS. 4 and 5, the positioning member 14 includes a pivotal lever 27 rotatably supported to the support shaft 12, drive arm 29, stopper 30 provided at a leading end of the pivotal lever 27, coupling bolt 31 for connecting a base end of the pivotal lever 27 to a leading end of the drive arm 29, and biasing member 32. The drive arm 29 is provided at the base end of the pivotal lever 27 and integrally connected to the support shaft 12 with a key 28. The biasing member 32, including a compression spring, is externally fitted to the coupling bolt 31 and biases the base end of the pivotal lever 27 in such a direction as to move the leading end of the lever 27 downward.

The stopper 30 is formed at a leading end of a lower member 35 securely mounted to an upper face of a slide plate 33 with mounting bolts 34, and projects from the leading end of the lower member 35 obliquely downward along a pivoting course of the pivotal lever 27 about the support shaft 12. The slide plate 33 is supported on an upper face of the leading end of the pivotal lever 27 slidably in a circumferential direction of the impression cylinder 6. In addition, the slide plate 33 is held from above by an upper member 37, which is disposed above the lower member 35 and secured to an upper face of the leading end of the pivotal lever 27 with mounting bolts 36. The stopper 30, lower member 35, and upper member 37 constitute a gripper.

At a rear end of the slide plate 33 is formed an upright wall 39 having a screw member 38 mounted thereto. To the screw member 38 is spirally fitted a screw shaft 41 of a drive means 40 for sliding the slide plate 33 and lower member 35. The drive means 40 includes a drive motor 44 mounted to a side face of the pivotal lever 27 through a mounting plate 43, timing belt mechanism 45 for transmitting the driving force of the drive motor 44, and worm gear mechanism 46 for deceleratingly transmitting the rotational force transmitted from the timing belt mechanism 45. The drive means 40 is constructed to minutely adjust an operative position of the stopper 30 with sliding of the slide plate 33 by driving the screw shaft 41.

As shown in FIG. 6, a notch 48 is so formed in the positioning plate 25 as to correspond to the shape of the stopper 30. The positioning member 14 moves down according to rotation of the support shaft 12 from an inoperative position indicated by a solid line in FIG. 6 to a holding position indicated in FIG. 7 through an intermediate position (stand-by position) indicated by a phantom line in FIG. 6. With the positioning member 14 in the inoperative position, a lower portion of the stopper 30 faces an upper end portion of the positioning plate 25. With the member 14 in the stand-by position, a leading end 49 of the upper member 37 is spaced away from the upper end of the positioning plate 25 by a distance slightly greater than the thickness of the printing material 26. With the member 14 in the holding position, the leading end 49 is in pressing contact with the leading end of the printing material 26. The leading end 49 of the upper member 37 is projecting forward of the upper end of the stopper 30, thereby serving as a restraining member for pressing the leading end of the printing material 26 to prevent it from warping upward when the printing material 26 is positioned as described hereinbelow.

Further, in the upright wall 39 of the slide plate 33 is provided a position sensor 50 for detecting how much the drive means 40 has slidingly moved the sliding plate 33 (actual moved amount of the slide plate 33) by measuring the distance between a support of the screw shaft 41 and the upright wall 39 (see FIG. 5). A sensor signal of the position sensor 50 is sent to a control unit 51 for controlling the drive motor 44. Upon receipt of this sensor signal, the control unit 51 executes a feed-back control based on the actual moved amount of the slide plate 33 and a target moved amount of the plate 33 input by manipulating an operation unit 52 including input switches, whereby to slide the plate 33 with accuracy.

Figure 7:
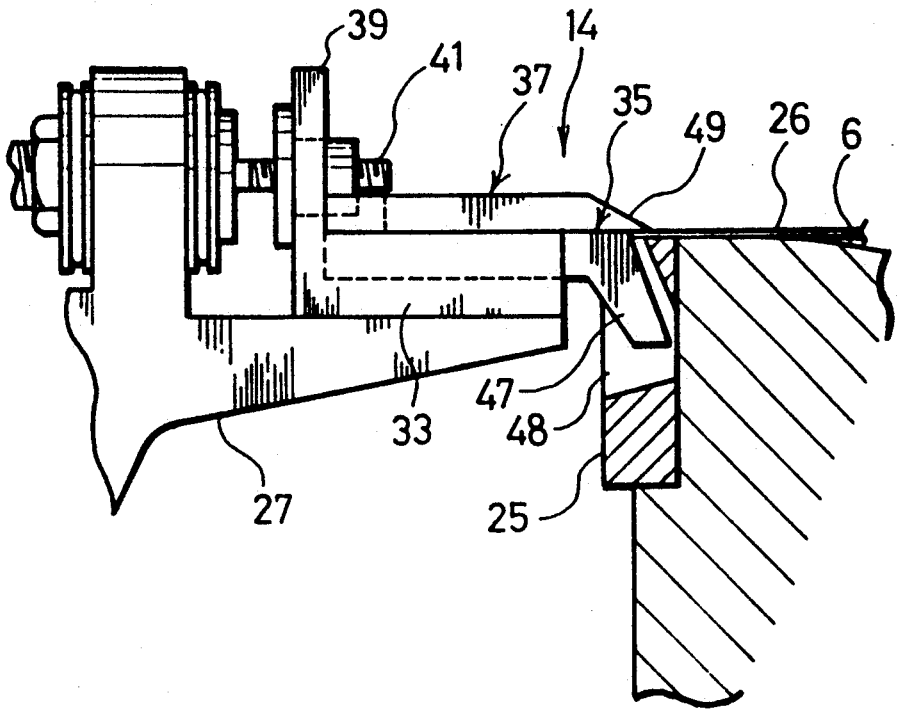
FIG. 7 is a diagram enlargedly showing the positioning member in its holding position.

In the printing apparatus thus constructed, the printing material 26 is transported to a position where the positioning member 14 of the impression cylinder 6 provided in the printing assembly 3 is disposed. When the leading end of the printing material 26 comes into contact with the stopper 30 in the stand-by position, the support shaft 12 is drivingly rotated by the cam mechanism 15 in synchronism with transport of the material 26, and thereby the leading ends of the holding members 13 and positioning members 14 move downward. As a result, the leading end of the printing material 26 is in contact with the stopper 30 and is held pressingly against the positioning plate 25 by the claws 22 of the holding member 13 as shown in FIG. 7.

In the case where the support shaft 12 rotates slightly more than is required to press the holding claws 22 and upper members 37 further against the printing material 26, the biasing members 24, 32 are compressed, whereby the support member 20 and the pivotal lever 27 rotate about the shaft 19 and support shaft 12 toward the inoperative positions respectively. This enables the holding claws 22 and upper member 37 to be reliably in pressing contact with the upper surface of the printing material 26 and prevents them from breaking.

The printing material 26 gripped by the impression cylinder 6 with the leading end thereof properly positioned as described above is fed, according to rotation of the cylinder 6, between the cylinder 6 and blanket cylinder 5 whose circumferential surfaces are in contact with each other at one point. The holding claw 22, upper members 37 and the like project outward of the circumferential surface of the impression cylinder 6. However, it should be noted that a recessed portion is formed at a position of the blanket cylinder 5 corresponding to these projections, so that the cylinders 5, 6 rotate smoothly without interfering with each other. After the leading end of the printing material 26 is nipped between the impression cylinder 6 and blanket cylinder 5, the holding members 13 and stoppers 30 move upward to the respective inoperative positions. Thereupon, the printing material 26 is released from the gripped state, and printing is applied to the material 26 while the material 26 is tightly held and fed between the cylinders 5, 6. Consequently, the printing material 26 is discharged. Then, it is confirmed whether the printing material 26 is properly positioned by the positioning member 14 by checking a printed state of the material 26. In the case where the positioning is conducted improperly, a position adjustment amount of the stoppers 30 and slide plates 33 are set based on how much images superimposed on the printing material 26 are displaced from each other.

Figure 8:
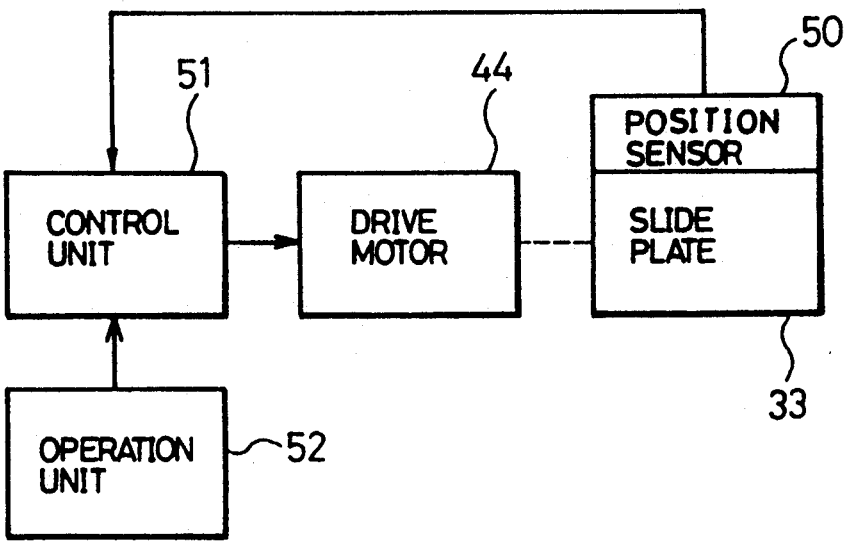
FIG. 8 is a block diagram showing a construction of control means for controlling drive means.
Figure 9:
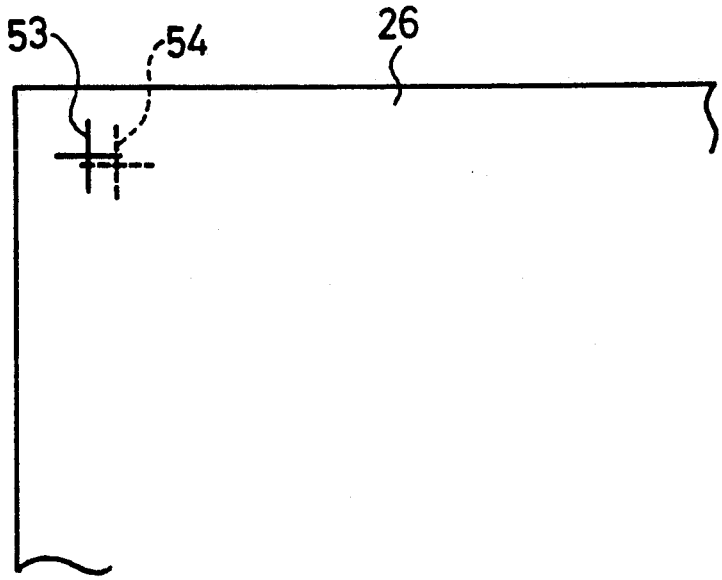
FIG. 9 is a plan view showing reference marks inscribed on printing material.
Figure 10:
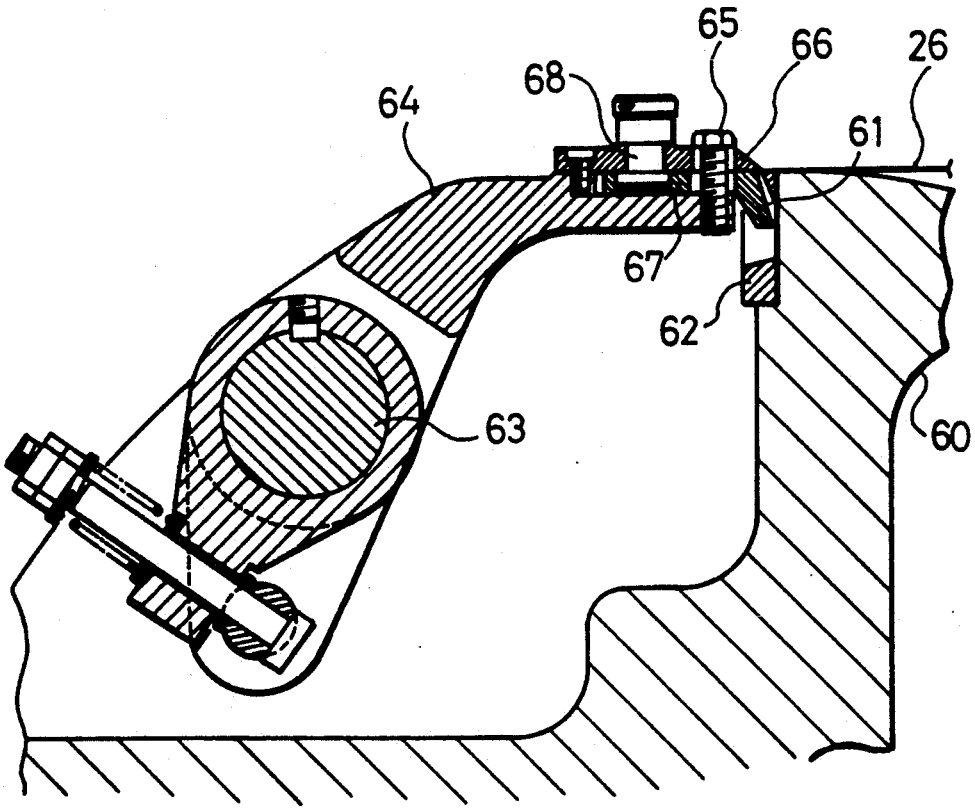
FIG. 10 PRIOR ART
FIG. 10 is a sectional view showing a construction of a positioning member provided in an existing printing apparatus.

It may be convenient to provide reference marks 53, 54 as shown in FIG. 9 to facilitate detection of the displacement of images. Formation of reference marks 53, 54, detection and adjustment of displacement of these marks are made as follows. For example, in a multi-color printing, when printing of a first color is applied to printing material 26, the reference mark 53 is inscribed on the printing material 26 in a specified position outside an image area, i.e., in a non-image area. When printing of a second color different from the first color is applied to the printing material 26, the reference mark 54 is inscribed in the same position in the non-image area of the printing material 26. The printing material 26 just having passed through between the blanket cylinder 5 and impression cylinder 6 is examined with the use of a magnifier to detect a displaced amount of reference marks 53, 54 in a direction of transport of the printing material 26. The position adjustment amount according to the detected displaced amount is instructed by manipulating the operation unit 52 shown in FIG. 8. The control unit 51 drives the drive motor 44 in accordance with the position adjustment amount to move the slide plate 33 forward or backward. The actual moved amount of the slide plate 33 is detected by the position sensor 50. The position sensor 50 sends a sensor signal to the control unit 51, which in turn drives the drive motor 44 to move the slide plate 33 by a specified amount. The slide plate 33 is moved while the impression cylinder 6 is being rotated. Accordingly, the position of the printing material 26 is adjusted during a printing process.

As described above, the positioning member 14 for positioning the leading end of the printing material 26 includes the slide plate 33 mounted to the impression cylinder 6 slidably in the circumferential direction thereof and drive means for slidingly moving the slide plate 33, whereby enabling adjustment of the plate 33 to be effected during the printing process. Accordingly, in the case where the images superimposed on the same printing material 26 are not in complete agreement with one another, the drive motor of the drive means 40 is drivingly rotated in accordance with the signal from the operation unit 52 to minutely adjust the position of the lower member 35. As a result, the position where the leading end of the printing material 26 is held is minutely adjusted, whereby correcting displacement of the printed images in the transport direction of the printing material 26. Further, it may be confirmed based on the printed state of the printing material 26 whether the above correction has been made properly.

Accordingly, the printing apparatus having a positioning device of the invention involves no cumbersome operation required for the existing printing apparatus. The cumbersome operation includes the steps of: stopping of the printing apparatus; manually and minutely adjusting the position of the lower member; starting the printing apparatus; and checking the printed state of the printing material. In the case where displacement of images is confirmed on the printing material, the printing apparatus is stopped again to make the above minute adjustment of the lower member. Therefore, in the printing apparatus having the positioning device of the invention, displacement of the printed images on the printing material in the direction of transport of the printing material 26 can be corrected rapidly and accurately.

Further, the control unit 51 may be provided with a conversion table defining the relationship between the displaced amount of reference marks 53, 54 and the corresponding adjustment amount of the stopper 30, i.e., an angle of rotation of the drive motor 44. This eliminates the need for an operation of estimating from experience or guessing a control amount of the stoppers 30 corresponding to the displaced amount of superimposed printed images. Therefore, the displacement of the superimposed printed images in the transport direction of the printing material can be corrected rapidly and accurately without skills.

As described above, in accordance with the invention, a sliding plate of a positioning member is slidingly moved by drive means, thereby enabling positioning of a stopper without stopping a printing apparatus. Accordingly, displacement of superimposed printed images resulting from the fact that the positioning member improperly positions printing material in the transport direction of the printing material can be corrected rapidly and accurately.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A device for positioning printing material for use in a printing apparatus in which printing is applied to the printing material by passing the material through between an impression cylinder and a blanket cylinder, the device comprising positioning means disposed in a recessed portion formed on an outer surface of the impression cylinder, said positioning means comprising:

a stopper positioned to contact a leading end of the printing material;

drive means mounted to move the stopper forward and backward in the direction of transport of the printing material;

control means connected to control said drive means while the impression cylinder is being rotated; and operation means for operating the control means for adjusting the stopper while the cylinder is being rotated.

2. A device as defined in claim 1 wherein the positioning means further includes a slide member integrally mounted to the stopper and slidable in a circumferential direction of the impression cylinder and the drive means is mounted to slidingly drive the slide member to move the stopper forward and backward.

3. The device of claim 1 wherein said drive means comprises a motor mounted on said positioning means and rotatable with said impression cylinder.

4. A device as claimed in claim 3 wherein the drive means further comprises a worm gear mechanism connected to the motor for moving the stopper forward and backward in the direction of transport of the printing material.

* * * * *